US005613789A

United States Patent [19]

Sugai

[11] Patent Number: 5,613,789

[45] Date of Patent: Mar. 25, 1997

[54] PLATEN FOR IMPACT PRINTER

[75] Inventor: Makoto Sugai, Saitama-ken, Japan

[73] Assignee: Citizen Watch Co., Ltd., Tokyo, Japan

[21] Appl. No.: 267,215

[22] Filed: Jul. 6, 1994

[30] Foreign Application Priority Data

Jul. 6, 1993 [JP] Japan ..... 5-191599

[51] Int. Cl.[6] ..... B41J 11/02

[52] U.S. Cl. ..... 400/661.2; 400/661

[58] Field of Search ..... 400/661.2, 661.3, 400/661, 659, 661.1, 661.4

[56] References Cited

U.S. PATENT DOCUMENTS 1,977,531 10/1934 Sperry ..... 400/659

FOREIGN PATENT DOCUMENTS 4034070 4/1992 Germany ..... 400/661.3

0162570 7/1987 Japan ..... 400/661.2

62-204973 9/1987 Japan .

63-3975 8/1988 Japan .

1078866 3/1989 Japan ..... 400/661

5042728 2/1993 Japan ..... 400/661.2

5318846 12/1993 Japan ..... 400/661

2089731 6/1982 United Kingdom ..... 400/661

OTHER PUBLICATIONS

Fowler, "Typewriter sound reduction" 400/661 IBM, Technical Disclosure Bulletin, vol. 12, No. 3, Aug. 1969.

*Primary Examiner*—Edgar S. Burr
*Assistant Examiner*—Anthony H. Nguyen
*Attorney, Agent, or Firm*—Wenderoth, Lind & Ponack

[57] ABSTRACT

A platen for an impact printer includes a hollow metal pipe having a hollow interior and inner and outer surfaces. A layer of elastic material covers the outer surface. A metal rod is inserted into the hollow interior and has an outer surface spaced from the inner surface to define therebetween a clearance. Such clearance is filled with a liquid.

13 Claims, 4 Drawing Sheets

PLATEN FOR IMPACT PRINTER

BACKGROUND OF THE INVENTION

The present invention relates to an improved platen for use in an impact printer. More particularly, the present invention relates to such a platen capable of reducing noise by absorbing vibrations that occur upon a print head of the printer striking a printing surface on the platen.

A conventional platen for an impact printer comprises a steel shaft having on an outer surface thereof a hard covering or layer of ebonite or other material. However, such conventional platen is very heavy, and this requires that the printer include a large driving motor for rotating the platen. Further, when a print head of the printer strikes the platen, substantial and large noise is generated. In view of such problems of the conventional platen, various attempts have been made to devise improved platens that are lighter in weight and that reduce noise upon striking by the printer print head.

For example, one attempted improvement is to replace the steel shaft with a hollow steel pipe. This arrangement reduces the weight of the platen, but the noise generated during printing is increased due to the resonance phenomenon of the hollow pipe.

One proposal to reduce such resonance phenomenon is disclosed in Japanese Patent Application Laid-Open No. 3975/1988. This arrangement fills the hollow pipe with liquid having a low viscosity. This solution reduces noise from the resonance phenomenon, but other noise newly is generated. Particularly, such platen cannot absorb efficiently vibrations imparted to the platen, and the platen acts as a transmitter of such vibrations. Another solution, disclosed in Japanese Patent Application Laid-Open No. 204973/1987 fills approximately 50% of the interior of the hollow pipe with granular material such as sand. This solution absorbs impact occurring on printing to reduce noise. However, this solution does not remove noise due to the resonance phenomenon because a portion of the interior of the hollow pipe is not filled, i.e. there is a space therein enabling movement of the granular material.

As a solution for such problems, the present inventor has provided a platen, disclosed in Japanese Patent Application Laid-Open No. 173725/1992. Such platen provides that the interior of the hollow pipe is filled with liquid and sheet or granular fragments within the liquid that rub against each other. This platen absorbs impacts during printing by means of inertia resistance of the mass of the many fragments and the liquid, frictional resistance occurring upon the fragments rubbing against each other through the liquid, and velocity resistance of the liquid. Therefore, vibrations that occur upon the print head striking the printing surface on the platen can be prevented, thereby reducing noise of the platen as well as noise of the printer frame and other parts of the printer due to transmission of such vibration. Such platen employs as the filler liquid for preventing vibrations an emulsion paint, such as Gelnac (trade name) made by Nippon Automatic Co., Ltd. However, the use of such material results in certain inherent disadvantages. Thus, such filler requires a drying process involving a long period of time, and this adversely effects productivity. Further, such filler is hard to treat and is high priced. Due to such disadvantages, it is difficult to produce a low priced printer employing such platen.

SUMMARY OF THE INVENTION

It is an object of the present invention to provide an improved platen for an impact printer whereby it is possible to overcome the above and other prior art disadvantages.

It is a further object of the present invention to provide such an improved platen for an impact printer whereby it is possible to reduce noise due to vibrations occurring upon impact by a print head of the impact printer, to reduce noise due to resonance phenomenon, and to reduce weight.

These objects are achieved in accordance with the present invention by the provision of a platen including a hollow metal pipe having a hollow interior and inner and outer surfaces, a layer of elastic material covering the outer surface, a rod inserted into the hollow interior and having an outer surface spaced from the inner surface to define a clearance therebetween, and a liquid filling such clearance. By provision of such improved platen, when a paper on a printing surface of the platen is struck by the print head of the printer, the platen body, including the hollow metal tube and the outer layer of elastic material, and the rod are vibrationally connected in series by the liquid, since the rod and liquid are filled into the hollow interior of the platen body. The platen body and the rod each inhibit vibrations in the other, and vibrations are absorbed by viscosity of the liquid. Therefore, vibrations occurring by impact of the print head are reduced, and printing noise thus also is reduced.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 3:
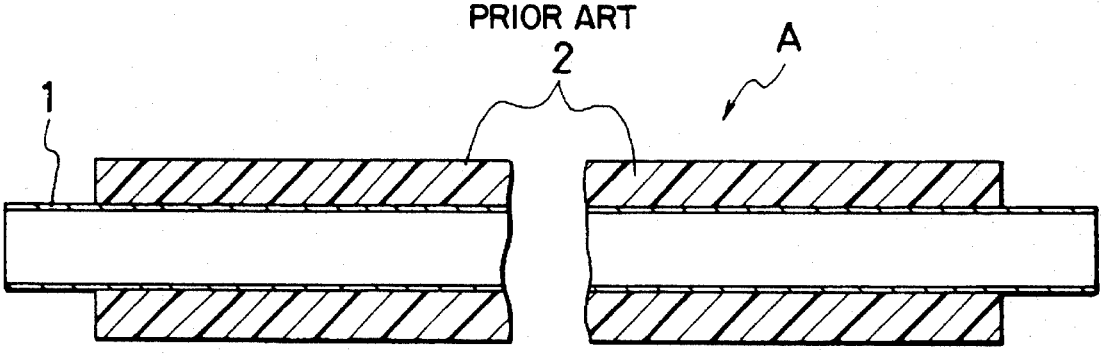
FIG. 3 PRIOR ART
FIG. 3 is a similar view of a further known platen.

FIG. 3 illustrates a conventional platen A comprising a hollow metal shaft 1 having on the outer surface thereof a cover or layer of resilient material 2. It specifically is contemplated that hollow shaft 1 has an inside diameter of 12 mm and is formed of carbon steel and that covering 2 is formed of hard rubber material. This known platen has the advantage of reduced weight, but has the disadvantage of noise generation due to the resonance phenomenon.

Figure 2:
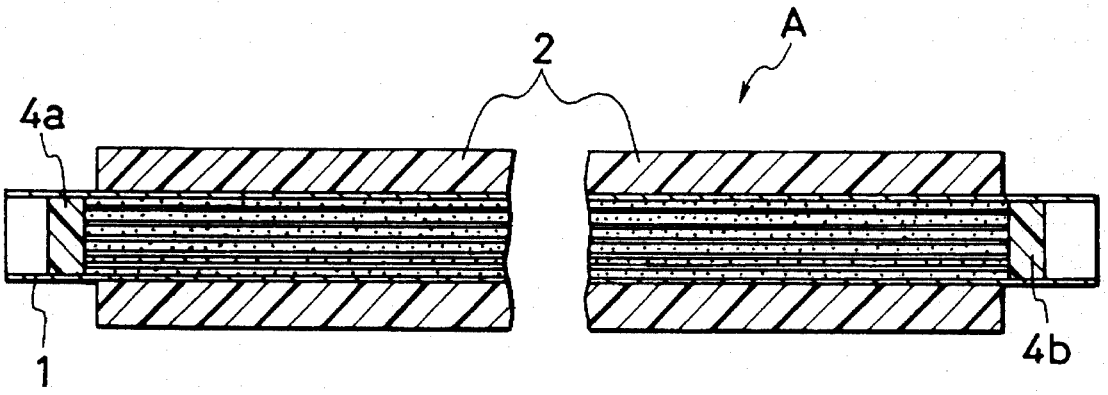
FIG. 2 PRIOR ART
FIG. 2 is a similar view of a known platen.

FIG. 2 illustrates an improved conventional platen A having the same hollow tube 1 and covering 2, but also wherein the hollow interior is completely filled with a large number of fragments and a dried liquid. It particularly is contemplated that the hollow interior of this known platen is filled with 105 wire-like fragments each having a diameter of 1 mm and dried Gelnac. Opposite ends of the hollow interior are closed with plugs 4*a*, 4*b*. This known platen however is expensive to produce.

Figure 1:
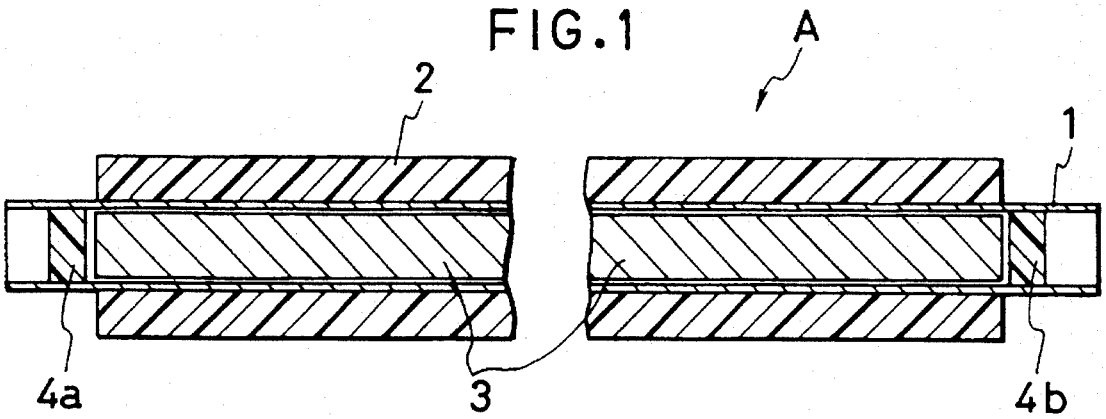
FIG. 1 is a longitudinal cross sectional view of one embodiment of an improved platen in accordance with the present invention.

On the other hand, FIG. 1 illustrates the improved platen A of the present invention. This platen also includes the hollow metal tube 1 and the outer covering 2 of elastic material. However, the hollow interior of the tube 1 has inserted therein a rod 3, for example a steel rod. Rod 3 has an outer surface that is spaced from the inner surface of hollow metal pipe 1 to define a clearance therebetween. This clearance is filled with liquid, and opposite ends are sealed, for example by rubber plugs 4*a*, 4*b* that may be spaced from respective ends of rod 3. It particularly is contemplated that steel rod 3 has a diameter of 11.85 mm, and that the thickness of the clearance between the outer surface of rod 3 and the inner surface of pipe 1 is approximately 0.1–0.2 mm. In accordance with the present invention it also is contemplated that hollow pipe 1 be formed of a known carbon steel employed in general machine construction and that the outer covering 2 is formed of a synthetic hard rubber material. It is preferable in accordance with the present invention that the rod 3 have a natural frequency that is different from a natural frequency of hollow pipe 1. In constructing the platen of FIG. 1, one end of hollow pipe 1 may be sealed with rubber plug 4*a*. Liquid is injected into the clearance between the metal pipe 1 and rod 3, and the opposite end may be sealed by rubber plug 4*b*. The resultant platen then may be employed in conjunction with a print head of an impact printer. The liquid employed in the present invention may be a high viscosity liquid or a low viscosity liquid. Particularly, it is contemplated that engine oil having a high viscosity or a low viscosity oil such as spindle oil, silicone oil and cutting oil may be used. Also, it is contemplated that the liquid may be water.

Figure 4:
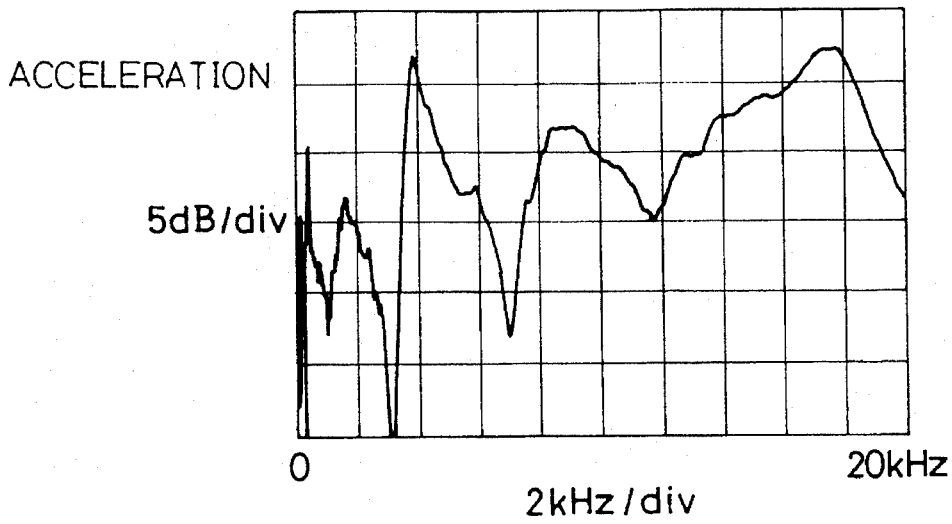
FIG. 4 is a graph of a frequency analysis when the platen of FIG. 3 is struck by a print head.
Figure 5:
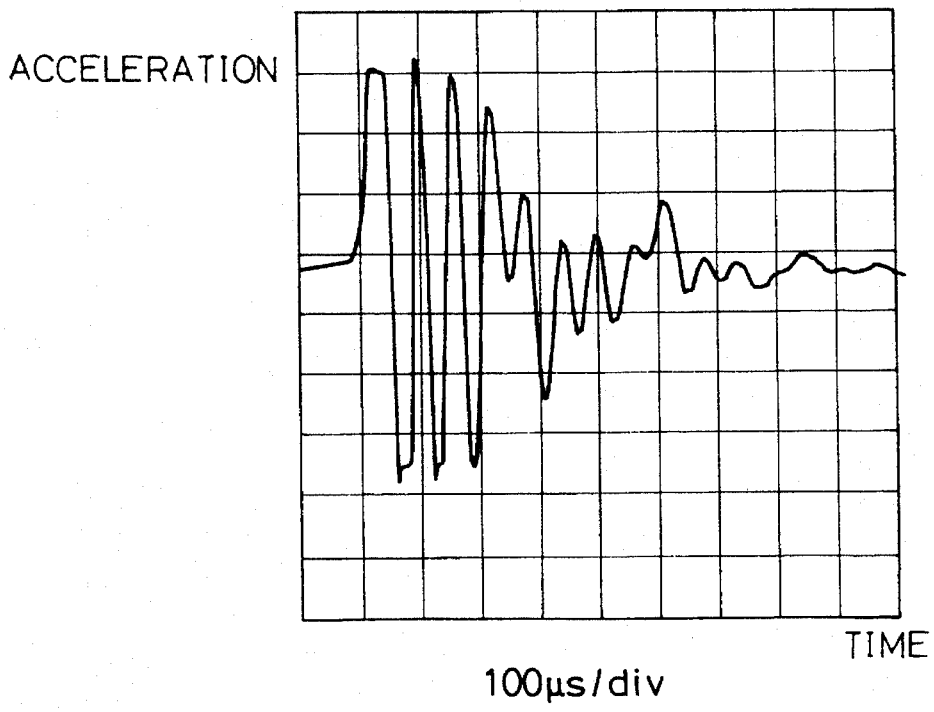
FIG. 5 is a graph showing the state of vibration when the platen of FIG. 3 is struck by the print head.
Figure 6:
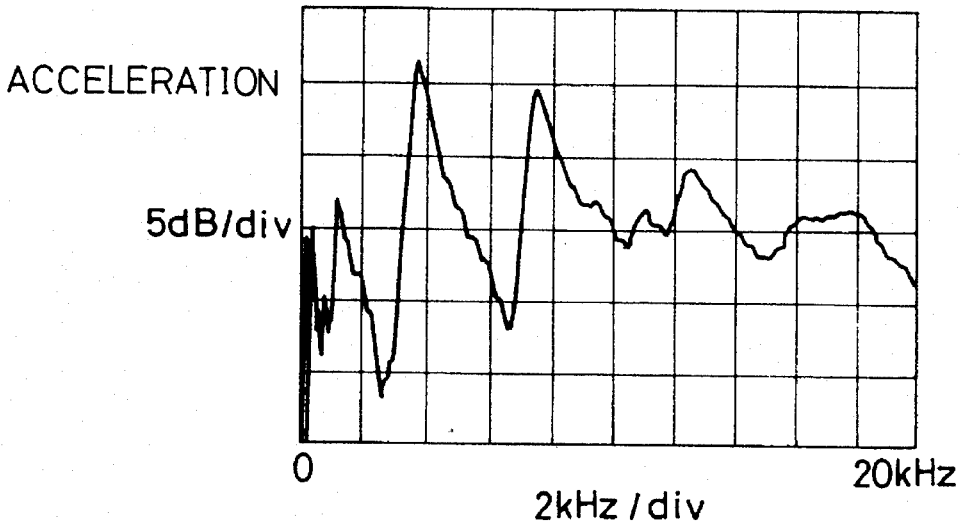
FIGS. 6 and 7 are graphs respectively similar to FIGS. 4 and 5, but when the platen of FIG. 2 is struck by a print head.
Figure 7:
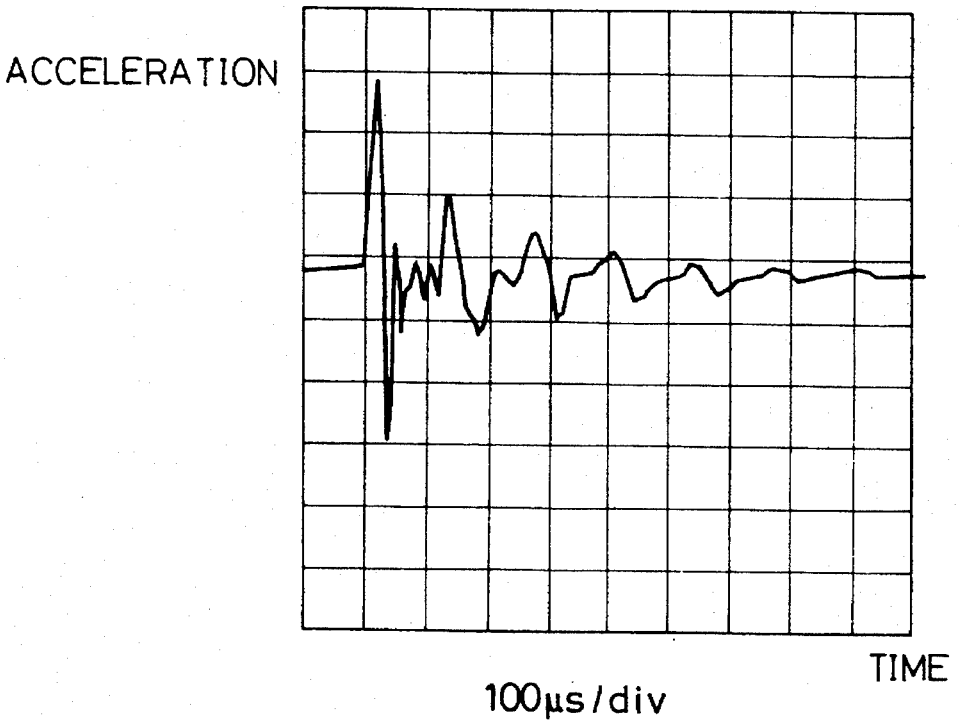
Figure 8:
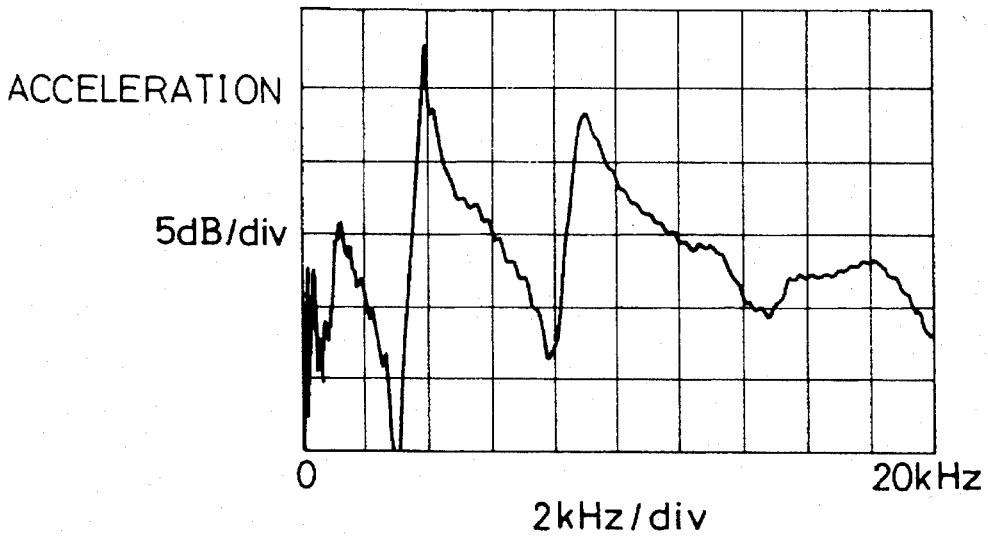
FIGS. 8 and 9 are graphs respectively similar to FIGS. 4 and 5, but wherein the platen of the present invention shown in FIG. 1 is struck by a print head.
Figure 9:
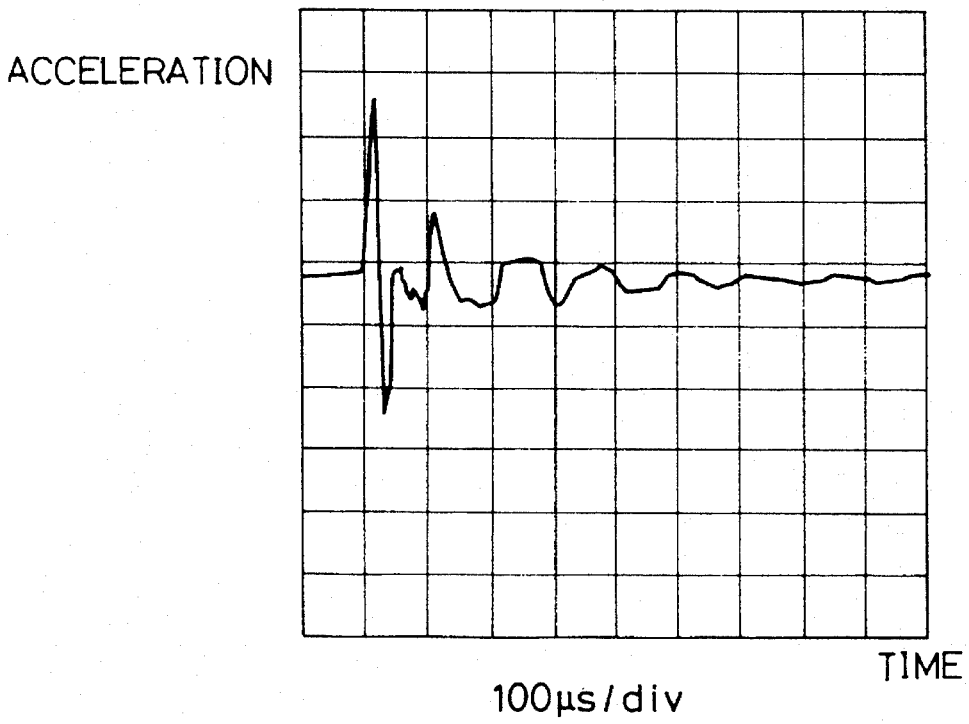

FIGS. 4–9 illustrate the noise and vibration frequency characteristics of the platen shown in FIGS. 1–3. Particularly, FIGS. 4, 6 and 8 relate respectively to noise frequency analysis characteristics of the platens of FIGS. 3, 2 and 1, and FIGS. 5, 7 and 9 relate to vibration characteristics of the platens respectively of FIGS. 3, 2 and 1. In each of FIGS. 4, 6 and 8, the transverse axis or abscissa shows frequency (kHz) and the ordinate axis shows strength of vibration (dB). In FIGS. 5, 7 and 9, the state of a vibration occurring when the respective platen is impacted by a print head is illustrated. The transverse axis indicates time, and the ordinate axis illustrates acceleration of vibration.

The platen of FIG. 3 that has a hollow, not filled interior vibrates as illustrated in FIG. 5, and the peak of frequency vibration is approximately 17 kHz as shown in FIG. 4. As shown in FIG. 5, the vibration is large and the frequency of vibration decreases slowly. As a result, noise is large.

FIGS. 6 and 7 show that the known platen of FIG. 2 is improved over the known platen of FIG. 3. Thus, the frequency peak adjacent 17 kHz is reduced substantially. Also, it will be apparent that vibration decreases more rapidly.

FIGS. 8 and 9 illustrate that characteristics of the platen of the present invention shown in FIG. 1 also are improved remarkably compared to the platen of FIG. 3. The size and decreasing speed of vibration are improved as shown in FIG. 9. The peak adjacent 17 kHz is improved as shown in FIG. 8, comparable to that of the platen of FIG. 2. In accordance with the platen of the present invention, a noise decrease of approximately 0.6 dB compared with the platen of FIG. 3 is possible.

Thus, in accordance with the platen of the present invention, it is possible to reduce noise at least to the same extent as noise reduction in the known platen of FIG. 2. However, the production of the platen of the present invention does not require the filler drying process necessary to produce the platen of FIG. 2. Thus, production can be done much more simply. Further, the materials employed for production of the present invention are less expensive than those necessary to produce the platen of FIG. 2. As a result, it is possible in accordance with the present invention to produce a improved platen that has at least the same noise reduction characteristics as the convention platen of FIG. 2, but wherein the unit cost is reduced significantly.

Since opposite ends of the hollow pipe may be sealed by rubber plugs, the production process is simple and inexpensive. If the natural frequency of the inserted rod is different from the nature frequency of the hollow pipe, the noise reduction is further improved remarkably.

Although the present invention has been described and illustrated with respect to a preferred embodiment thereof, it is to be understood that various modifications and changes may be made to the specifically described and illustrated embodiment without departing from the scope of the present invention.

I claim:

1. A platen for an impact printer, said platen comprising:

a hollow metal pipe having a hollow interior and inner and outer surfaces;

a layer of elastic material covering said outer surface;

a rod inserted into said hollow interior and having an outer surface spaced from said inner surface to define a clearance of approximately 0.01–0.2 mm therebetween; and liquid filling said clearance.

2. A platen as claimed in claim 1, wherein said elastic material comprises rubber.

3. A platen as claimed in claim 1, wherein said rod has a natural frequency different from a natural frequency of said hollow pipe.

4. A platen as claimed in claim 1, wherein said rod comprises a solid rod.

5. A platen as claimed in claim 1, wherein said rod comprises a metal rod.

6. A platen as claimed in claim 1, wherein said clearance has sealed opposite longitudinal ends.

7. A platen as claimed in claim 1, further comprising plugs fitting into and sealing opposite longitudinal ends of said hollow pipe.

8. A platen as claimed in claim 7, wherein said plugs comprise rubber plugs.

9. A platen as claimed in claim 7, wherein said plugs are spaced from respective ends of said rod.

10. A platen as claimed in claim 1, wherein said liquid comprises a high viscosity liquid.

11. A platen as claimed in claim 1, wherein said liquid comprises a low viscosity liquid.

12. A platen as claimed in claim 1, wherein said liquid comprises an oil.

13. A platen as claimed in claim 1, wherein said liquid comprises water.

* * * * *